United States Patent [19]

Bergsten

[11] Patent Number: 4,653,458

[45] Date of Patent: Mar. 31, 1987

[54] ARRANGEMENT FOR CONNECTING A POSITION SENSING TRANSDUCER TO A MACHINE

[75] Inventor: Lars Bergsten, Järna, Sweden

[73] Assignee: Saab-Scania Aktiebolag, Sodertalje, Sweden

[21] Appl. No.: 810,185

[22] Filed: Dec. 18, 1985

[30] Foreign Application Priority Data

Dec. 20, 1984 [SE] Sweden ..... 8406533

[51] Int. Cl.[4] ..... F02P 1/00

[52] U.S. Cl. ..... 123/612; 123/599; 123/146.5 A

[58] Field of Search ..... 123/146.5 A, 612, 613, 123/616, 617, 599, 476, 195 A

[56] References Cited

U.S. PATENT DOCUMENTS

| | | | |
|---|---|---|---|
| 2,537,856 | 1/1951 | Raleigh | 123/612 |
| 2,835,833 | 5/1958 | Hofmann | 123/612 |
| 3,867,916 | 2/1975 | Bigalke | 123/146.5 A |
| 3,974,817 | 8/1976 | Henderson | 123/599 |
| 4,036,190 | 7/1977 | Bigliani | 123/146.5 A |

FOREIGN PATENT DOCUMENTS

| | | | |
|---|---|---|---|
| 760734 | 11/1932 | France | 123/612 |
| 1321473 | 2/1962 | France | 123/612 |
| 378441 | 2/1973 | Sweden | 123/612 |
| 627172 | 8/1944 | United Kingdom | 123/612 |

*Primary Examiner*—Ronald B. Cox

*Attorney, Agent, or Firm*—Cushman, Darby & Cushman

[57] ABSTRACT

The invention relates to an arrangement for enabling the connection of a position sensing transducer to a machine such that the transducer is not subjected to high temperatures or dirt. In accordance with the invention the transducer is mounted on the outside of a housing in which there is mounted a rotatable means which extends outside the housing to operate a drive means for driving auxiliary equipment. The invention is distinguished in that the position sensing transducer includes a disc fixed to the drive means, said disc coacting in non-contacting relationship with a transducer mounted on the outside of the housing for indicating the angular positions of the disc, and in that the drive means and housing include portions concentrically disposed to form a labyrinth seal to a space which accommodates the position sensing transducer. The invention is intended for use in an Otto-type internal combustion engine to connect a transducer which senses the angular position of the engine crankshaft, thus making possible control of the engine ignition timing with great accuracy.

5 Claims, 2 Drawing Figures

ARRANGEMENT FOR CONNECTING A POSITION SENSING TRANSDUCER TO A MACHINE

BACKGROUND OF THE INVENTION

The present invention relates to an arrangement in connecting a position sensing transducer to an internal combustion engine, the transducer being mounted on the outside of a housing, preferably a cylinder block, in which there is mounted a rotatable means, e.g. a crankshaft, which outside the housing carries a drive means for driving auxiliary equipment.

In multi-cylinder Otto-type I.C. engines it is known to control the ignition timing in the respective combustion chambers with the aid of a mechanically driven distributor, This is usually driven by gearing from the engine camshaft, which is in turn driven from the engine crankshaft via a belt drive. It is thus possible to control the engine ignition timing in response to angular positions of the crankshaft, and thus also in response to piston position in the different cylinders.

Driving the distributor in the way described above results in a plurality of transmission transfers which, due to play between the components concerned, impairs the accuracy of controlling the ignition timing relative the angular positions of the crankshaft. The ignition instant in the respective combustion chamber is of great importance in optimizing the combustion process. Incorrect or inaccurate timing causes drawbacks such as increased fuel consumption, reduced power and/or increased exhaust gas emission.

It is known, for the purpose of better controlling ignition timing, to arrange electrical transducers that sense the camshaft angular positions directly, and in response thereto directly control the respective instants of ignition.

Although this means an improvement in relation to an entirely mechanically driven distributor, there remains the drawback that there may be play in the transmission between crankshaft and camshaft which impairs accuracy.

To achieve the best possible accuracy in controlling ignition timing, it is necessary to directly sense the crankshaft angular position. The possibilities of placing an electric transducer on known engine structures is limited, however, and for this reason such transducers have not found any practical application. Placing a transducer in the engine crankcase causes the transducer to be subjected to a temperature that is too high for it to function in the intended manner. Placing the transducer outside the engine, e.g. on a belt pulley at one end of the crankshaft, results in the transducer being subjected to dirt which can endanger its function.

SUMMARY OF THE INVENTION

The present invention has the object of enabling the connection of a position sensing transducer to a machine such that the transducer is not subjected to high temperatures or dirt.

In accordance with the invention, the position sensing transducer includes a disc fixed to the drive means, said disc co-acting in non-contacting relationship with a transducer mounted on the outside of the housing for indicating angular positions of the disc, the drive means and housing have portions concentrically disposed to form a labyrinth seal for a space which accommodates the position sensing transducer.

The invention thus enables a transducer which controls the instant of ignition to be located in a place where there are no injuriously high temperatures. Furthermore, the transducer is protected against dirt, since there is only a narrow gap between the drive means and the housing pertaining to the machine, this gap also being formed as a labyrinth seal. Other distinguishing features of the invention will be understood from the following description of an inventive arrangement in a multi-cylinder, Otto-type I.C. engine.

DETAILED DESCRIPTION OF THE INVENTION

Figure 1:
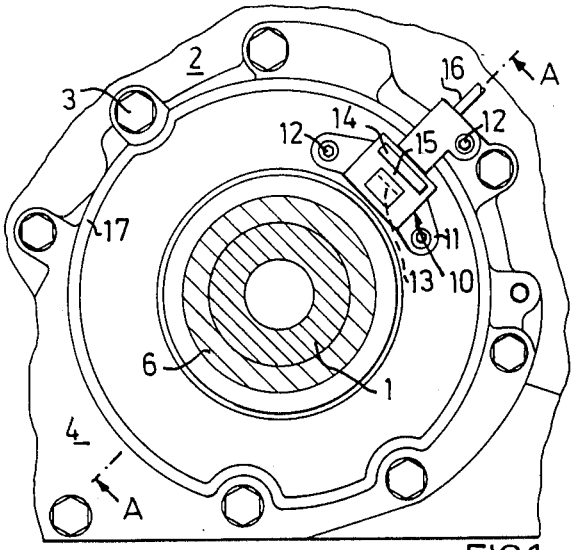
Figure 2:
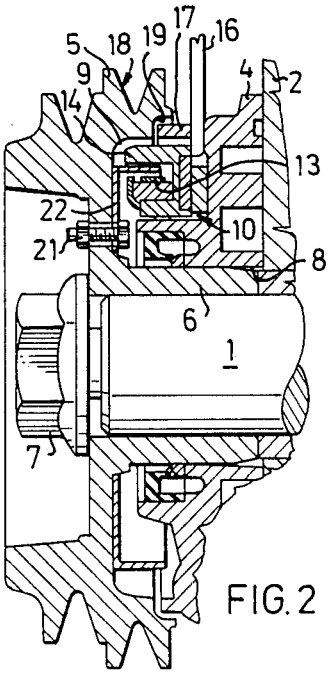

The description now will be described in greater detail with reference to the accompanying drawings, in which FIG. 1 is a fragmented end elevation view of an I.C. engine without a belt pulley and FIG. 2 is sectional view taken along line A—A of FIG. 1, with the added feature of a belt pulley mounted on the engine crankshaft.

Otto-type I.C. engines are well-known, and it is not necessary to know their construction in detail to understand the significance of the present invention, although a short description of such an engine will now be given by way of introduction.

The exemplified engine includes a cylinder block accommodating four cylinders and their pistons. The respective pistons are connected to a crankshaft 1, rotatably mounted in the cylinder block. One end of the crankshaft carries a chainwheel included in the engine camshaft drive transmission. At its other end the crankshaft 1 is connected to a flywheel, and engine power is taken from this end.

The transmission between crankshaft 1 and the camshaft is covered by a transmission casing 2 bolted to the cylinder block, the transmission casing being partially visible in the figures. The casing 2 is made with a cut-out accommodating a lubrication pump, said cut-out being covered by an oil pump cover 4 secured by bolts 3 to the casing 2. The oil pump is driven by a gear fixed to the previously mentioned chainwheel on the crankshaft 1.

Attached to the outmost end of the crankshaft there is a belt pulley 5 which is part of a belt transmission for driving auxiliary engine equipment such as a generator, servo steering pump and the like. The belt pulley 5 is made with a hub 6 rigidly attached to the crankshaft 1 by a bolt 7 at the end thereof.

The oil pump cover 4 is made with a central hole 8, at least partially accommodating the hub 6 of the belt pulley.

The figures have been restricted to illustrating the oil pump cover 4, belt pulley 5 and an annular space 9 therebetween including the inventive arrangement.

On its outside the oil pump cover 4, fastened to the casing 2 by the bolts 3, carries a position sensing transducer 10, hereinafter designated "sensor". This sensor 10 is adapted to sense the angular position of the crankshaft in order to control suitable ignition timing for the engine. The sensor 10 is of the non-contacting type, and includes a mounting plate 11 fastened by three bolts 12 to the oil pump cover 4 inwardly of an annular flange 17 extending axially and substantially concentrically with the central hole 8 in the oil pump cover 4. The sensor 10 also includes a permanent magnet 13 and a Hall effect transducer 14, the latter elements being separated from each other by a narrow gap 15. The transducer 14, magnet 13 and plate 11 are partially moulded into epoxy plastics, and in a fitted condition the transducer 14 is connected to the engine ignition system by an electric cable 16.

The belt pulley 5 is conventionally formed with a plurality of V grooves 18 for V belts. Internally, on the side facing the oil pump cover 4, the pulley 5 is provided with a recess 19. In an assembled state on the crankshaft 1, the flange 17 fits into the recess 19 of the pulley 5 to form a labyrinth seal with only a small gap between the recess 19 and the flange 17.

A metal disc 22, the periphery of which is folded into a axially extending cylindrical portion, is attached to the inside of the belt pulley 5 by bolts 21. The cylindrical wall of the disc 22 fits into the gap 15 between the magnet 13 and the transducer 14. Said cylindrical wall is provided with two opposing cut-outs. The wall of the disc 22 prevents the magnetic field surrounding the magnet 13 from affecting the transducer 14. Only when the cut-outs in the wall of the disc 22 are between the magnet 13 and the transducer 14 can the magnetic field affect the transducer 14, and when this happens the latter generates an output signal. The cut-outs in the cylindrical wall of the disc 22 are preferably arranged so as to provide output signals indicating when the respective pistons in the engine have assumed positions in the vicinity of their top dead centres. In this way the Hall effect trransducer 14 generates a signal every time one of the pistons is at its top dead centre.

Although there is no direct drawback from the aspect of combustion for a four stroke engine to let the spark plugs spark each time some piston is at its top dead centre, such sparking does cause unnecessarily great wear on the spark plugs. To avoid this, the ignition system may be supplemented with a transducer arranged, for example, on the engine camshaft, the transducer being utilized together with the Hall effect transducer 14 for controlling the ignition times. The implementation of this concept is outside the scope of the present invention and is therefore not described further.

The operative relationship between the Hall effect transducer 14 and the rotating disc 22 allows the angular position of the crankshaft 1 to be indicated with great accuracy, which in turn signifies that the ignition timing in the engine cylinders may be controlled with great accuracy. The ignition timing may also be controlled conventionally by engine loading and running conditions, so that actual ignition occurs at a time other than that indicated by the signal from the Hall effect transducer for a given angular position of the crankshaft.

When the engine is in operation, the belt pulley 5 will rotate, as well as the disc 22 attached to it. When the cut-outs on the cylindrical wall of the disc 22 pass through the magnetic field between the magnet 13 and the transducer 14, the latter sends a signal to the engine ignition system.

Placing the sensor 10 radially inwardly of the flange 17 results in the sensor 10 and the disc 22 being protected against dirt. However, should dirt come through the narrow gap between the recess 19 of the belt pulley 5 and the flange 17, this dirt will be cast out by centrifugal force when the belt pulley 5 rotates. This means that the space 9 may be regarded as self-cleaning. The location of the sensor 10 also results in its being protected against the high temperatures which can be prevalent with I.C. engines.

Within the scope of the following claims the invention can be implemented and modified differently from what has been stated in connection with the described embodiment.

What I claim is:

1. An arrangement connecting a position sensing transducer in operative relationship with an internal combustion engine having a housing for receiving a rotatable drive means driven by said engine, said transducer being mounted outside of said housing and the drive means extending beyond the housing to drive auxiliary equipment, the invention being characterized in that the transducer comprises a disc fixed to an extending portion of the drive means in non-contacting operative relationship with a sensor mounted on the outside of said housing whereby the sensor indicates angular positions of the disc, said extending portion of the drive means and the exterior of the housing having concentrically arranged portions to define a labyrinth seal for a space within which the transducer is accommodated.

2. An arrangement as set forth in claim 1, wherein the concentrically arranged portions comprise an annular flange formed on the outside of said housing and a recess provided within the drive means, the flange being received within said recess.

3. An arrangement as set forth in claim 1, wherein the sensor comprises a permanent magnet spaced from a Hall effect device, the disc including a portion having equidistantly spaced cut-outs, said cut-out portion being movable within the space between the magnet and the Hall effect device in response to rotation of the drive means.

4. An arrangement as set forth in claim 1, wherein the housing is a cylinder block of the internal combustion engine, the rotatable drive means is a crankshaft, the extending portion of the drive means is a pulley, and the transducer is attached to a cover removably mounted on the cylinder block.

5. An arrangement as set forth in claim 4, wherein the transducer comprises a portion of an electrical system for controlling the engine's ignition in response to angular positions of the crankshaft.

* * * * *